US009365919B2

(12) United States Patent
Raghavan

(10) Patent No.: US 9,365,919 B2
(45) Date of Patent: Jun. 14, 2016

(54) METHOD FOR REDUCTION OF TIME IN A GAS CARBURIZING PROCESS AND COOLING APPARATUS UTILIZING A HIGH SPEED QUENCHING OIL FLOW RATE

(76) Inventor: Bhagavan Raghavan, Bangalore (IN)

( * ) Notice: Subject to any disclaimer, the term of this patent is extended or adjusted under 35 U.S.C. 154(b) by 460 days.

(21) Appl. No.: 13/603,256

(22) Filed: Sep. 4, 2012

(65) Prior Publication Data

US 2012/0325372 A1 Dec. 27, 2012

Related U.S. Application Data

(63) Continuation-in-part of application No. 12/970,986, filed on Dec. 17, 2010, now abandoned.

(51) Int. Cl.

| | |
|---|---|
| ***C23C 8/20*** | (2006.01) |
| ***C21D 1/58*** | (2006.01) |
| ***C21D 1/62*** | (2006.01) |
| ***C21D 1/74*** | (2006.01) |
| ***C21D 1/76*** | (2006.01) |
| ***C23C 8/22*** | (2006.01) |
| ***F27B 17/00*** | (2006.01) |
| ***C23C 8/80*** | (2006.01) |
| ***F27D 15/02*** | (2006.01) |

(52) U.S. Cl.

CPC ... *C23C 8/20* (2013.01); *C21D 1/58* (2013.01); *C21D 1/62* (2013.01); *C21D 1/74* (2013.01); *C21D 1/76* (2013.01); *C23C 8/22* (2013.01); *C23C 8/80* (2013.01); *F27B 17/0083* (2013.01); *F27D 15/02* (2013.01); *F27D 15/0286* (2013.01)

(58) Field of Classification Search

CPC ..... C21D 1/58; C21D 1/62; C21D 1/74; C21D 1/76; F27D 15/0286; F27D 15/02; C23C 8/22; C23C 8/20; C23C 8/80; F27B 17/0083

USPC ..... 148/235, 233, 206; 266/251, 252

See application file for complete search history.

(56) References Cited

U.S. PATENT DOCUMENTS

| | | | | |
|---|---|---|---|---|
| 3,201,290 | A * | 8/1965 | Wyss | 148/216 |
| 4,145,232 | A * | 3/1979 | Solomon | 148/218 |
| 4,386,973 | A * | 6/1983 | Kawka et al. | 148/223 |
| 4,597,807 | A * | 7/1986 | Fenstermaker et al. | 148/235 |
| 4,807,853 | A * | 2/1989 | Murakami et al. | 266/81 |
| 4,846,669 | A * | 7/1989 | Melgaard | 432/59 |
| 5,795,538 | A * | 8/1998 | Abukawa et al. | 266/46 |
| 2005/0133120 | A1 * | 6/2005 | Walenta et al. | 148/233 |
| 2008/0073001 | A1 * | 3/2008 | Katsumata | 148/223 |
| 2010/0159235 | A1 * | 6/2010 | Johnston et al. | 428/332 |

* cited by examiner

*Primary Examiner* — Scott Kastler
*Assistant Examiner* — Michael Aboagye
(74) *Attorney, Agent, or Firm* — Patwrite LLC; Mark David Torche

(57) ABSTRACT

The present invention provides a process for reduction of time in gas-carburizing process and cooling apparatus to perform carburization by step heating of a part during carburizing heating from 800° C., 850° C., 900° C. onwards to a carburization temperature of 930° C. with the part being held at each mentioned temperature for 10 minutes by adding LPG or propane along with methanol in the furnace for activation/diffusion, the holding time is thereby reduced for carburization, thereafter the carburized parts are quenched in the invented apparatus to discharge high severity of quenching. A quenching oil flow rate of about 1.6 meters per second is critical to the process.

15 Claims, 4 Drawing Sheets

METHOD FOR REDUCTION OF TIME IN A GAS CARBURIZING PROCESS AND COOLING APPARATUS UTILIZING A HIGH SPEED QUENCHING OIL FLOW RATE

CROSS REFERENCE TO RELATED APPLICATIONS

This application is a continuation in part of U.S. patent application Ser. No. 12/970,986, filed Dec. 17, 2010, the entire contents of which is hereby incorporated by reference.

BACKGROUND OF THE INVENTION

In general, a gas carburizing process would require an atmospheric heat treating furnace herein called heat treating furnace along with a gas generator for conventional carburizing. However there are existing designs that use heat treating furnaces for carburizing without a gas generator. Example of this is a drip feed type furnace with Methanol for direct carburizing.

Prior art and problem to be solved: In the conventional method, the carburization starts from the time heat treating furnace attains the temperature of 930° C. to begin the process, but in the present invention the carburization starts from 800° C., 850° C., 900° C. to 930° C. In the conventional method the process of quenching takes place with low agitation quenching & oil velocity (rpm), wherein in the present invention the agitation varies from 1200-1500 rpm with high velocity rate of quenching.

This cooling apparatus of the present invention is a significant innovative step as compared to conventional cooling apparatus.

The present invention reduces the total cycle time during carburization and diffusion in the carburizing process, and to lower the production cost of the carburization processing. The present invention allows carburization on a part to start from 800° C. by adding LPG or propane along with methanol during heating and during the withholding duration. The other object of the invention is to begin carburizing much earlier than what it would have achieved after beginning of carburizing at 930° C.

Further object of the invention is after the process of completing carburizing process; the parts need to be quenched. The Quenching apparatus in this invention has made significant changes as compared to conventional quenching apparatus which is about 0.25 $in^{-1}$. The further object of the invention is to enhance the severity of quench apparatus by surpassing the conventional severity of quench by 0.43-0.8 $in^{-1}$.

SUMMARY OF THE INVENTION

The present invention provides a process for reduction of time in gas-carburizing process and cooling apparatus to perform carburization by step heating of a part during carburizing heating from 800° C., 850° C., 900° C. onwards to a carburization temperature of 930° C. with the part being held at each mentioned temperature for 10 minutes by adding LPG or propane along with methanol in the furnace for activation/diffusion, the holding time is thereby reduced for carburization, thereafter the carburized parts are quenched in the invented apparatus to discharge high severity of quenching. A quenching oil flow rate of about 1.6 meters per second is critical to the process.

Other features and advantages of the instant invention will become apparent from the following description of the invention which refers to the accompanying drawings.

BRIEF DESCRIPTION OF THE DRAWINGS

FIG. 4 also illustrates the diffused carbon content with steel from the surface for conventional carburizing.

DETAILED DESCRIPTION OF THE INVENTION

Figure 1B:
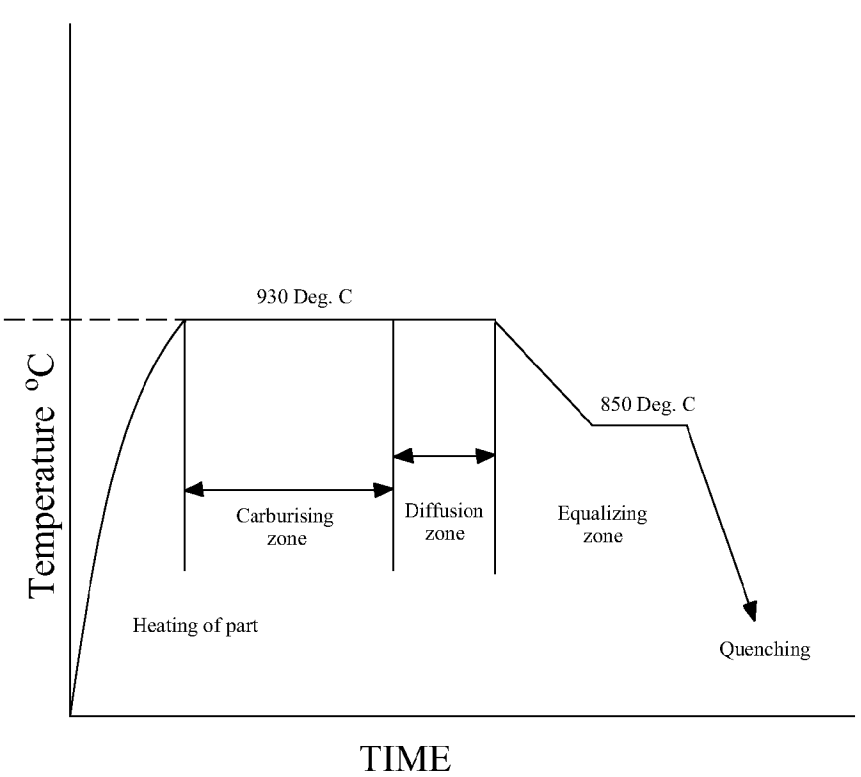
FIG. 1B show a practical heat cycle for carburizing. The part is heated at predetermined temperature at 930° C. for carburizing in the furnace with the atmosphere. When the part reaches the carburizing temperature 930° C., this confirms that the carburization has started and with diffusion cycle to follow. In conventional methods it is assumed that carburizing starts at 930° C.
Figure 1A:
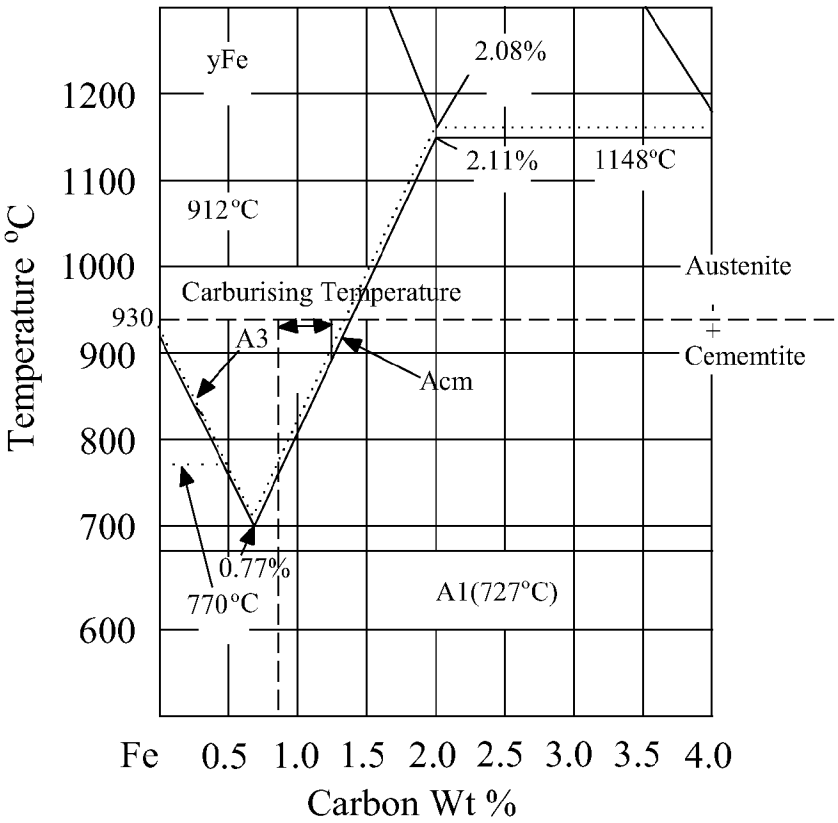
FIG. 1A illustrates the conventional carburizing method on an Fe (Iron) and Carbon phase diagram showing carburization performed at the predetermined temperature of 930° C.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Figure 2:
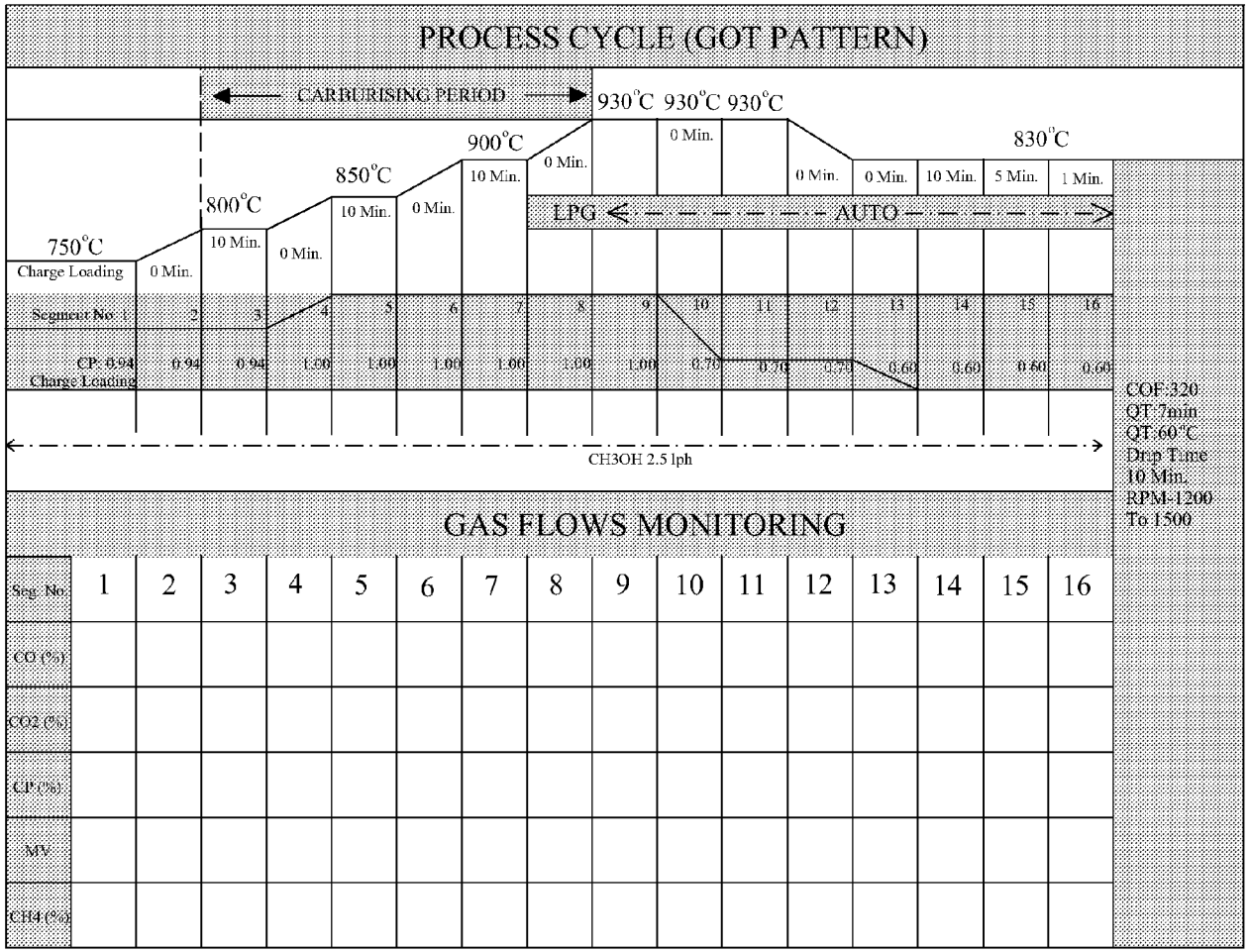
FIG. 2 illustrates the characteristic of this invention is before the parts reaches the carburizing temperature 930° C. The process starts with a step heating from 800° C., 850° C., 900° C. and 930° C. with the part being held at each mentioned temperature for 10 minutes.
Figure 4:
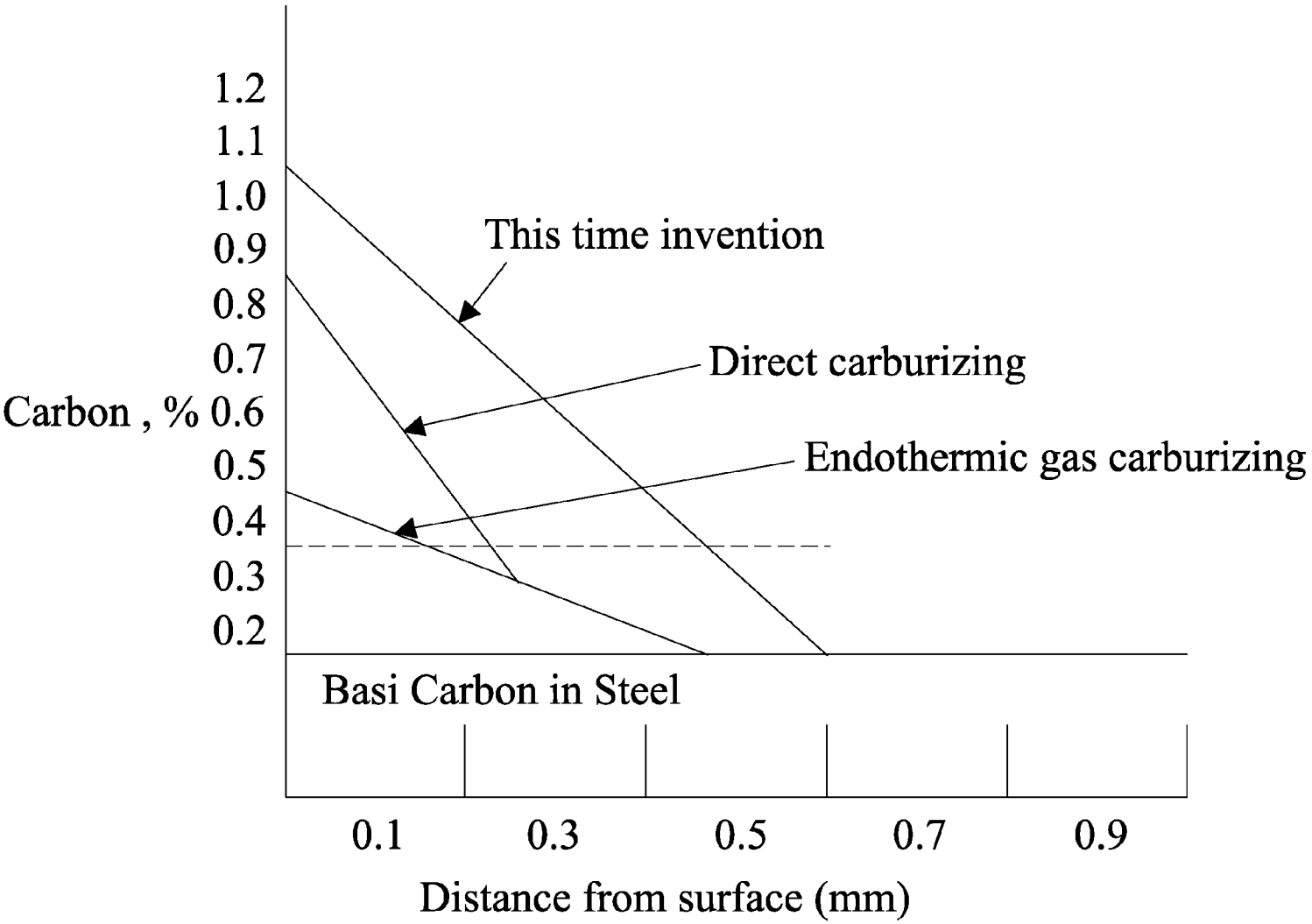
FIG. 4 illustrates the state of art of carburization in heating from 800° C. to 930° C. This figure confirms that the diffused carbon content in the steel from the surface and to a depth of penetration from the surface. From this result, it is declared that the carburization is carried out from 800° C. to 930° C.

Carburization on a part starts from 800° C. by adding LPG or propane along with a methanol gas in the furnace. This begins the carburizing process. During this period the temperatures are maintained at 800° C., 850° C. and 900° C. for a duration of 10 minutes. With the rise of temperatures from 800° C., 850° C., 900° C. and 930° C. the carburization takes place by the presence of LPG and propane along with methanol inside the furnace. To allow penetration of saturated carbon content to the surface of the part is done by altering the carbon potential at each set temperature (as above). The apparatus required to operate in manual or automatic mode a certain quantity of LPG or propane along with methanol to reach the required carbon potential at the set temperature. As shown in FIG. 2, the surface carbon content is diffused. As shown in FIG. 4, the surface carbon content reaches 1.1% at 930° C. more effectively. This shows that the carburization takes place during the step heating of the part.

Detailed Description

Cooling Apparatus

Figure 3:
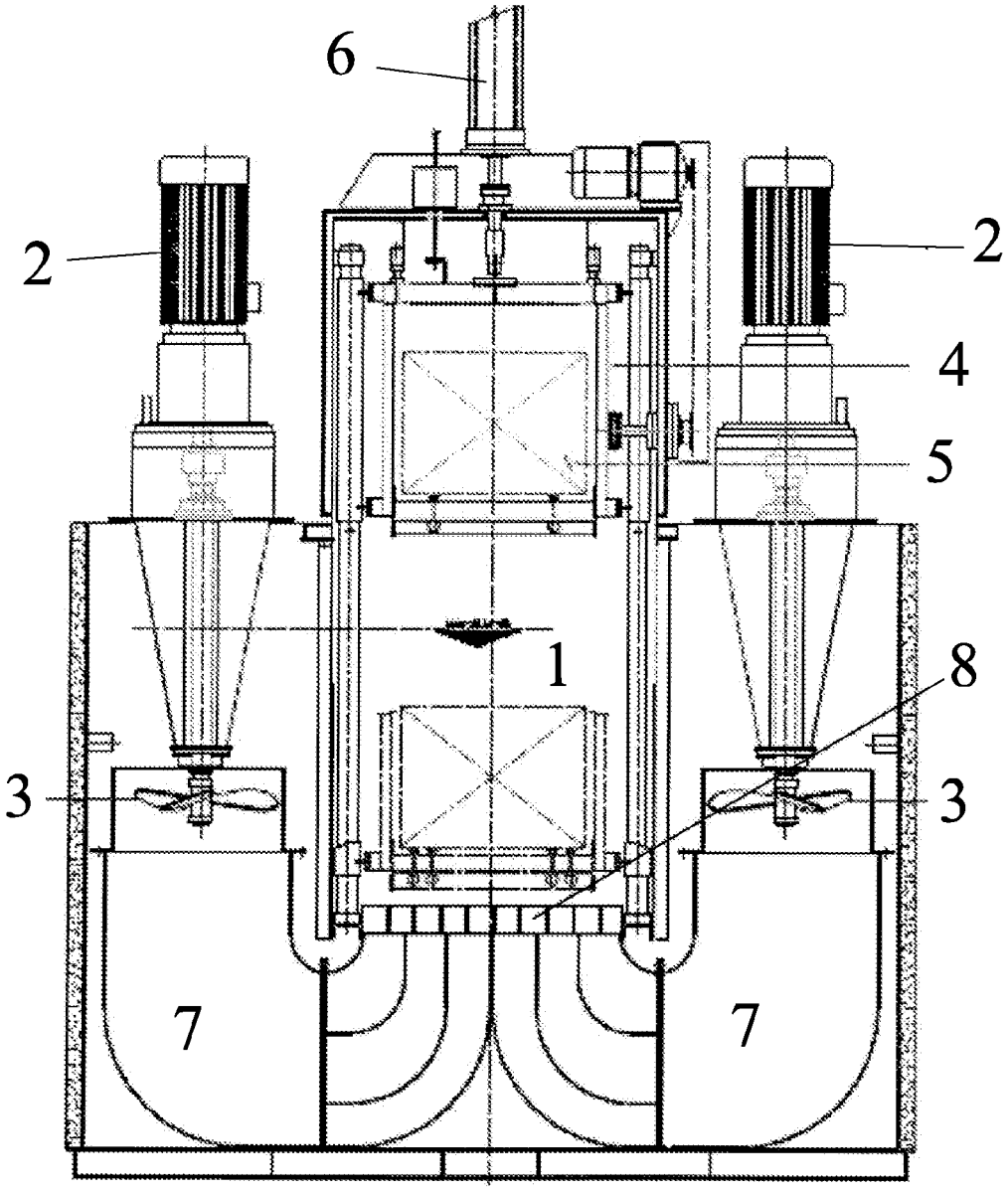
FIG. 3 is an illustration of a quench oil cooling apparatus according the present invention.

As shown in FIG. 3, the cooling apparatus has four sets of agitating motors 2. Each agitating motor 2 drives a propeller 3 that moves quenching oil within the cooling apparatus. Oil flow is controlled by changing the speed of agitating motors 2 using invertors (not shown) as is known in the art. Each one of agitating motor 2 is attached to a quench oil movement pipe 7. Each one of quench oil movement pipe 7 has an input end and an exit end. The input end of quench oil movement pipe 7 is connected to agitating motor and directs oil through quench oil movement pipe 7. The quenching oil is directed towards the exit end. A perforated grid 8 is installed at each of the exit ends of quench oil movement pipes 7. Propellers 3 provide agitation. A work movement elevator 4 is provided to move the work held in a work basket 5. An elevator drive cylinder 6 is provided to move elevator 4. Quench oil movement pipes 7 direct quenching oil through perforated grid 8 to equalize the flow rate of the quenching oil. Perforated grid 8 is a type of grillwork with 100 mm openings provided to equalize the flow rates of the quenching oil during the time of quenching of the parts in the lattice.

This cooling apparatus has two characteristics (1) introduce homogeneous cooling: (2) Improve the severity of quench. The severity of quench is 0.80 $in^{-1}$ at 1500 rpm in the new process. The severity quench is 0.25 $in^{-1}$ in the conventional process. This illustrates the innovative capability of the quenching mechanism. This produces a critical flow rate of around 1.6 meters per second with the quenching oil temperature of around 60 degrees Centigrade. This increased flow rate over the prior art produces a more uniform faster cooling of the selected steel part and thereby enhances the quench severity which cools the part faster. This results in a more uniformly distributed martensitic structure which in turn enhances the effective case depth. Only by utilizing the instant's invention's flow rate will the above hardening characteristics be realized. Additionally, the increased flow rates result in reduced processing time as discussed above.

The function of the cooling apparatus shown in FIG. 3 is as follows:

The quenching oil starts flowing through quench oil circulation pipe 7 and it is jetted through perforated grid by the churning effect of propeller 3. Work basket 5 comes down to the quenching oil and the work (job) is quenched into the cooling oil.

Practical Example

Effective Case Depth is 1.5 mm

Scope/Ambit of Invention:
The result of CO, $C0_2$ and Carbon Potential.

TABLE 1

| Temp (° C.) | LPG add | CO % | $CO_2$ % | CP % |
|---|---|---|---|---|
| 800 | 2 | 35.39 | 2.885 | 0.42 |
| After 10 min | 2 | 34.27 | 1.656 | 0.72 |
| 850 | 1 | 34.17 | 1.18 | 0.7 |
| After 10 min | 1 | 34.07 | 0.869 | 0.87 |
| 900 | 1.5 | 32.33 | .0609 | 1.03 |
| After 10 min | 2 | 1.1 | 32.37 | 1.1 |
| 930 | 2 | 31.7 | 0.555 | 1.07 |

This invention: Heating from 800° C. to 930° C.: 100 min.
Carburizing: 4 hour, Diffusing: 2 hour total: 7.67 hour.
Conventional: Heating 70 min.
Carburizing: 5 hour, Diffusing: 3 hour total: 9.12 hour.
Reduction: 16%

Practical Example

Effective Case Depth is 1.0 mm

This invention: Heating from 800° C. to 930° C.: 85 min.
Carburizing: 3 hour, Diffusing: 1 hour total: 5.42 hour.
Conventional: Heating 55 min.
Carburizing: 5.5 hour, Diffusing: 2 hour total: 8.42 hour.
Reduction: 36%
This invention clearly reduces the cycle time.

Practical Example of Cooling Apparatus

The revolutions per minute of the motor is changed as shown in FIG. 3 and severity of quench is measured by increasing the revolutions per minute of the motor, the effectiveness of the cooling is drastically improved.

The number of revolutions of the motor revealed that the severity of quench became $0.80^{-1}$ at the time of 1,500 rpm.

In addition, distortion level is examined after the heat-treatment by the Navy test specimen. We noted the severity of the quench in the range from $0.43^{-1}$ to $0.8^{-1}$ did not offer any significant difference in a level of risk of 5% in a range from $0.43^{-1}$ to $0.8^{-1}$.

The test made on the part, showed the quantity of carbon at pre-determined positions which showed an effective case depth (Hv550) 0.28% from 0.4% (conventional law) by improving severity of quench to $0.43^{-1}$.

The above statement illustrates a very unique advantage of the quenching apparatus.

Although the instant invention has been described in relation to particular embodiments thereof, many other variations and modifications and other uses will become apparent to those skilled in the art.

What is claimed is:

1. A method for reduction of time in gas-carburizing, process utilizing step heating comprising the steps of:

placing a part into an atmospheric carburizing furnace;

said carburizing furnace comprising;

a quenching chamber;

a plurality of quench oil circulation pipes;

each of said plurality of quench oil circulation pipes having an input end and an exit end;

an agitating motor connected to said each of said input end; wherein quenching oil is directed to flow through therein at a selected flow rate and a perforated grid disposed on each of said exit end for selectively increasing said selected flow rate wherein said quenching oil is directed through said quenching chamber and recirculated;

heating said part to a first selected temperature;

holding said first temperature for a first selected time interval while adding a hydro-carbon gas along with methanol into said furnace;

heating said part to a second selected temperature;

holding said second temperature for a second selected time interval while adding a hydro-carbon gas into said furnace;

heating said part to a third selected temperature;

holding said third temperature for a third selected time interval while adding a hydro-carbon gas into said furnace;

heating said part to a final selected temperature;

holding said final temperature for a final selected time interval while adding a hydro-carbon gas into said furnace; and wherein said first selected temperature is 800° C., said second selected temperature is 850° C., said third selected temperature is 900° C. and said selected final temperature is 930° C.

2. The method for reduction of time in gas-carburizing process utilizing step heating according to claim 1 wherein said first, second, third and final selected time periods are each 10 minutes long.

3. The method for reduction of time in gas-carburizing process utilizing step heating according to claim 1 further comprising the step of quenching said part in quenching oil flowing at said selected flow rate through said quenching chamber.

4. The method for reduction of time in gas-carburizing process utilizing step heating according to claim 1 wherein said selected flow rate is at least 1.6 meters per second.

5. The method for reduction of time in gas-carburizing process utilizing step heating according to claim 3 wherein said selected flow rate is obtained by operating a propeller at between 1200 to 1500 rpm wherein this flow rate improves the microstructure of said part by increasing the effectiveness and severity of the quench and increases the effective case depth.

6. The method for reduction of time in gas-carburizing process utilizing step heating according to claim 1 wherein said perforated grid has a plurality of openings generally having a dimension of 100 mm.

7. A method for reduction of time in gas-carburizing, process utilizing step heating comprising the steps of:

placing a part in a quench oil cooling gas carburizing apparatus comprising;

an atmospheric quenching chamber;

at least one circulation pipe;

said at least one circulation pipe having an input end and an exit end;

a basket disposed within said atmospheric quenching chamber hold said part therein;

a movement means for moving said basket within said quenching chamber; and an agitation means for circulating a quenching oil;

said agitation means being disposed on said input end;

a perforated grid disposed on said exit end and connected to a lower end of said atmospheric quenching chamber; wherein said quenching oil is made to circulate at a selected flow rate; wherein said selected flow rate is increased as passing through said perforated grid;

heating said part to a first selected temperature;

holding said first temperature for a first selected time interval while adding a hydro-carbon gas into said furnace;

heating said part to a second selected temperature;

holding said second temperature for a second selected time interval while adding a hydro-carbon gas along with methanol into said furnace;

heating said part to a third selected temperature;

holding said third temperature for a third selected time interval while adding a hydro-carbon gas into said furnace;

heating said part to a final selected temperature; and holding said final temperature for a final selected time interval while adding a hydro-carbon gas into said furnace;

wherein said first selected temperature is 800° C., said second selected temperature is 850° C., said third selected temperature is 900° C. and said selected final temperature is 930° C.

8. The method for reduction of time in gas-carburizing process utilizing step heating according to claim 7 wherein said first, second, third and final selected time intervals are each 10 minutes long.

9. The method for reduction of time in gas-carburizing process utilizing step heating according to claim 8 further comprising the step of quenching said part in quenching oil flowing at said selected flow rate.

10. The method for reduction of time in gas-carburizing process utilizing step heating according to claim 8 wherein said selected flow rate is selected to be between 1200 to 1500 rpm wherein this flow rate improves the microstructure of said part by increasing the effectiveness and severity of the quench and increases the effective case depth.

11. The method for reduction of time in gas-carburizing process utilizing step heating according to claim 7 wherein said furnace is an atmospheric batch furnace.

12. The method for reduction of time in gas-carburizing process utilizing step heating according to claim 7 wherein said furnace is an atmospheric continuous furnace.

13. The method for reduction of time in gas-carburizing process utilizing step heating according to claim 7 wherein said hydrocarbon gas is selected from the group consisting of LPG and propane.

14. The method for reduction of time in gas-carburizing process utilizing step heating according to claim 7 where said selected flow rate is at least 1.6 meters per second.

15. The method for reduction of time in gas-carburizing process utilizing step heating according to claim 7 wherein said perforated grid has a plurality of openings generally having a dimension of 100 mm.

* * * * *